US005528220A

United States Patent [19]

Woods

[11] Patent Number: 5,528,220

[45] Date of Patent: Jun. 18, 1996

[54] ANTI-GRAFFITI APPARATUS

[76] Inventor: Gloria Woods, 303 Nordina St., Redlands, Calif. 92373

[21] Appl. No.: 407,389

[22] Filed: Mar. 20, 1995

[51] Int. Cl.[6] ..... G08B 13/19

[52] U.S. Cl. ..... 340/541; 340/540; 340/567; 340/691; 340/693

[58] Field of Search ..... 340/691, 541, 340/540, 567, 693, 309.15

[56] References Cited

U.S. PATENT DOCUMENTS

| | | | |
|---|---|---|---|
| 2,041,540 | 5/1936 | Goldstone | 340/693 |
| 3,257,654 | 6/1966 | Rogers et al. | 340/309.15 |
| 4,936,388 | 6/1990 | LeLande, Jr. | 169/46 |
| 4,991,657 | 2/1991 | LeLande, Jr. | 169/46 |
| 4,996,521 | 2/1991 | Hollow | 340/691 |
| 5,015,994 | 5/1991 | Hoberman et al. | 340/567 |
| 5,182,541 | 1/1993 | Bajorek et al. | 340/428 |
| 5,273,060 | 12/1993 | Hill, III et al. | 134/57 R |
| 5,311,166 | 5/1994 | Frye | 340/541 |

*Primary Examiner*—Glen Swann
*Attorney, Agent, or Firm*—Thomas I. Rozsa; Tony D. Chen

[57] ABSTRACT

An anti-graffiti apparatus is for deterring taggers from performing tagging on private or public property such as freeway sound walls, freeway signs, tunnels, bridges, buildings, and other similar structures. The anti-graffiti apparatus is mounted adjacent to the top of the building wall. The anti-graffiti apparatus has a protective armor which protects the components of the anti-graffiti apparatus. The anti-graffiti apparatus has at least one sensor which is electrically connected to at least one in-line water valve which in turn is connected to a series of sprinkler spray heads which will spray water or other graffiti removing substances onto the walls. The sensor is mounted within the protective armor and directed down towards the ground and is adjacent the side wall of the building where graffiti is likely to occur. When someone comes adjacent the wall anywhere along the cover range of the sensor, the motion of the person will automatically activate the sensor which will in turn open the valve to cause the sprinkler heads to spray water or other anti-graffiti substance onto the walls and onto the tagger.

21 Claims, 2 Drawing Sheets

FIG.1
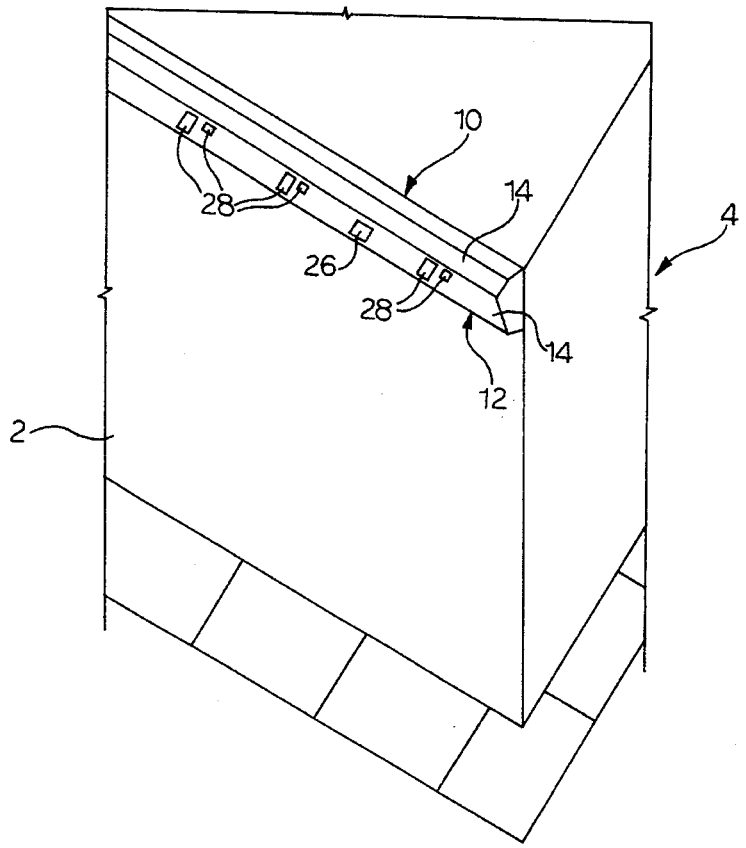
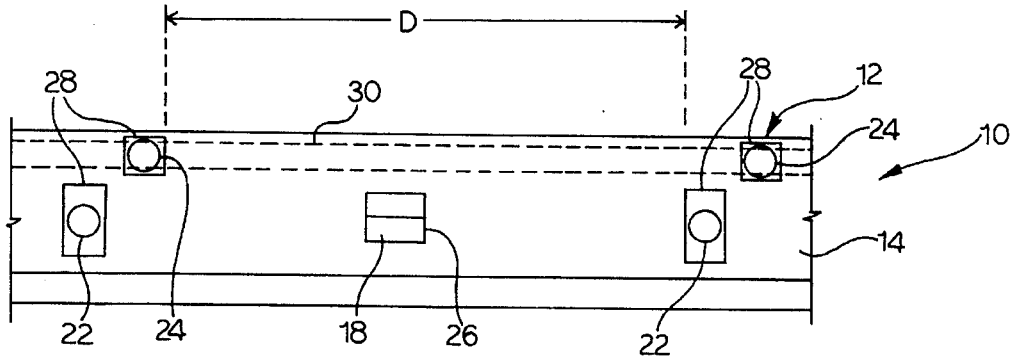
FIG.2
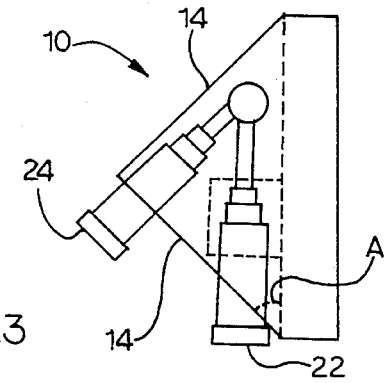
FIG.3

ANTI-GRAFFITI APPARATUS

BACKGROUND OF THE INVENTION

FIELD OF THE INVENTION

Taggers are individuals who mark surfaces of walls and buildings with graffiti by spray painting onto the walls. The present invention relates to an apparatus for deterring taggers from performing unauthorized tagging on private or public property.

DESCRIPTION OF THE PRIOR ART

Generally, common outdoor environmental areas such as freeway sound walls, freeway signs, buildings, tunnels, bridges, and other similar structures are at risk from being defaced by taggers. These areas are constantly being defaced by taggers. Writing and drawing by taggers is accomplished through the use of spray paint. Such drawing and/or writing greatly diminishes the value of the private or public property. Graffiti is a constant problem within any city, large or small.

Currently, the only way to correct graffiti is after the fact. Once a structure has been tagged, the municipality arranges to either have the graffiti erased or have the structure painted to cover the graffiti. Such procedures very expensive for the municipality.

The following six (6) prior art patents were uncovered in the pertinent field of the present invention:

1. U.S. Pat. No. 4,936,388 issued to LeLande, Jr. on Jun. 26, 1990 for "Fire Suppression System" (hereafter "the '388 LeLande Patent");

2. U.S. Pat. No. 4,991,657 issued to LeLande, Jr. on Feb. 12, 1991 for "Fire Suppression System" (hereafter "the '657 LeLande Patent");

3. U.S. Pat. No. 4,996,521 issued to Hollow on Feb. 26, 1991 for "Intrusion Deterrent Apparatus" (hereafter "the Hollow Patent");

4. U.S. Pat. No. 5,182,541 issued to Bajorek et al on Jan. 26, 1993 for "Remote Controlled Theft Deterrent System" (hereafter "the Bajorek Patent");

5. U.S. Pat. No. 5,273,060 issued to Hill, III et al. on Dec. 28, 1993 for "Alcohol Spray Cleaning System" (hereafter "the Hill Patent"); and 6. U.S. Pat. No. 5,311,166 issued to Frye on May 10, 1994 for "Security Vestibule" (hereafter "the Frye Patent").

The '388 LeLande Patent discloses a fire extinguishing system for roof fires. It comprises a fire sensor for monitoring a condition indicative of a fire and signals the sensing of the condition. A fire extinguishing system is used for spraying a fire retardant fluid onto an exterior surface of an associated roof. A logic circuit is connected to the fire sensor and the fire extinguishing device for actuating the fire extinguishing device as driven by the fire sensor.

The '657 LeLande Patent discloses a fire extinguishing system for roof fires. It comprises a fire sensor for monitoring a condition indicative of a fire and signals the sensing of the condition. It also comprises a wind sensor for monitoring wind speed and the composition of the fire retardant fluid is regulated by the control circuit based on readings from the wind sensor.

The Hollow Patent discloses an intrusion deterrent apparatus which activates a water spraying device in a specific area to prevent unauthorized activities within that area. The device can be installed with pre-existing equipment such a previously installed irrigation system located on the ground or a wall mounted sprinkler system. The apparatus comprises two pole type devices affixed to the ground in front of the wall structure and having sensors mounted on the poles at a location elevated from the ground. The sensors are used to detect the presence of a human being within a specific area located directly adjacent the fixed structure that is to be protected. The apparatus also comprises a circuit for operating a valve which is activated at appropriate times by a time clock and sensors which are connected to the water spraying system.

The Bajorek Patent discloses a remote controlled theft deterrent system. The device is used for enclosures such as dwellings and motor vehicles having one or more entrance ways. The device emits a noxious gas upon unauthorized entry into the enclosure.

The Hill Patent discloses an alcohol spray cleaning system for spraying flammable solvent. It comprises a cleaning chamber, a nozzle for directing a spray of solvent against the article to be cleaned in the chamber, and a pump for supplying solvent to the nozzle. The chamber is ventilated with a flow of air to maintain the concentration of solvent. The air is exhausted to create a negative pressure within the chamber. The chamber has sensors for detecting combustion.

The Frye Patent discloses a security vestibule which is armed with interior deterrents and exterior deterrents. The exterior deterrents include a first set of motion detectors which sense the presence of an intruder and provide a signal to speakers to produce a verbal warning response. The interior deterrents include a second set of motion detectors for signalling nozzles to dispense water and electrifying both the interior walls and interior doors of the vestibule.

It is therefore highly desirable to have a very efficient and also very effective design and construction of an anti-graffiti apparatus which has the capability of rapidly and effortless spraying a building wall or any other structure with water or other lubricating substance to prevent the spray paint from adhering to the structure and also to deter the potential tagger who may flee to avoid being sprayed.

SUMMARY OF THE INVENTION

The present invention is an anti-graffiti apparatus for deterring taggers from performing an unauthorized tagging on private or public property such as freeway sound walls, freeway signs, tunnels, bridges, buildings, and other similar structures.

The anti-graffiti apparatus is mounted adjacent to the top of the building wall or other structure. It comprises a protective armor for protecting the internal functions of the anti-graffiti apparatus. The anti-graffiti apparatus comprises at least one passive infrared sensor which is electrically connected to at least one in-line valve which in turn is connected to a series of sprinkler spray heads which will spray water or other graffiti removing substances onto the walls. The sensor is mounted within the protective armor and directed down towards the ground and is adjacent the side wall of the building where graffiti is likely to be tagged.

On the other end of the in-line valve is connected to the main water valve inlet to the plant or building or alternatively, to a tank which contains oil like substances for removing graffiti. The sensor will have a cover range of 50 feet×50 feet wide angle. When someone comes adjacent the wall anywhere along the cover range of the sensor, the motion of the person will automatically activate the sensor which will in turn open the valve to cause the spray nozzles to spray water or other anti-graffiti substance onto the walls and to the tagger. The sensor may be connected to a timer means so that it will only be activated during times when there is not heavy pedestrian traffic adjacent the walls and when tagging is most likely.

It is therefore an object of the present invention to provide an anti-graffiti apparatus for deterring taggers from performing an unauthorized tagging on private or public property such as freeway sound walls, freeway signs, buildings, tunnels, bridges, and other similar structures.

It is also an object of the present invention to provide an anti-graffiti apparatus which utilizes a protective armor so that the entire internal functions of the anti-graffiti apparatus is protected from vandals or taggers.

It is another object of the present invention to provide an anti-graffiti apparatus utilizing a passive infrared sensor which is mounted at a 45° angle, so that the sensor will be at an optimal position for sensing motion from taggers.

It is an additional object of the present invention to provide an anti-graffiti apparatus which can be installed in a wide variety of different ways depending upon the requirement of a particular circumstance so that the anti-graffiti apparatus can be easily adapted to any situation.

It is also an object of the present invention to provide an anti-graffiti apparatus which utilizes two side-by-side adjacent sprinkler heads, so that one of the sprinkler head sprays water on the building wall to prevent graffiti on the wall and the other sprinkler head sprays water at the tagger for scaring and getting the tagger drenched.

It is still an object of the present invention to provide an anti-graffiti apparatus utilizing off-the-shelf components which can be adapted to the anti-graffiti apparatus so that it would be inexpensive to manufacture the anti-graffiti apparatus.

It is a further object of the present invention to provide an anti-graffiti apparatus which can be utilized with pre-existing plumbing equipment.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 1 is a perspective view of a fixed structure such as a building wall with the present invention anti-graffiti apparatus being depicted mounted in conjunction with the wall;

FIG. 2 is a front elevational view of the present invention anti-graffiti apparatus, showing the protective armor and the arrangement of the components;

FIG. 3 is a side elevational view of the present invention anti-graffiti apparatus, showing the 45° angle of the protective armor and the sprinkler heads at different angles;

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Described briefly, the present invention is an anti-graffiti apparatus. A preferred embodiment of the anti-graffiti apparatus comprises an elongated protective armor, a plurality of passive infrared sensors, a plurality of in-line valves, a plurality of two side-by-side adjacent sprinkler heads, and timer means. Specifically, the anti-graffiti apparatus is custom designed for a particular application such that the plurality of passive infrared sensors, the plurality of in-line valves and the plurality of two side-by-side adjacent sprinkler heads will vary depending on the situation, and only one each will be described in detail.

Referring to FIG. 1, there is illustrated a perspective view of a vertical wall 2 of a building 4 equipped with the present invention anti-graffiti apparatus 10. The anti-graffiti apparatus 10 is designed to be installed on the vertical wall 2 at a location adjacent to top of the building 4 for deterring taggers from performing an unauthorized tagging on the building wall 2. The anti-graffiti apparatus 10 can be used with private or public property.

It will be appreciated that the building 4 illustrated above is merely one illustrative embodiment and the present invention can be used with many other different applications, for example such as freeway sound walls, freeway signs, tunnels, bridges, and other similar structures.

The components of the anti-graffiti apparatus 10 are designed to be compatible with pre-existing plumbing equipment of the building 4 so that the cost in manufacturing the components for the anti-graffiti apparatus 10 is substantially reduced.

Figure 4:
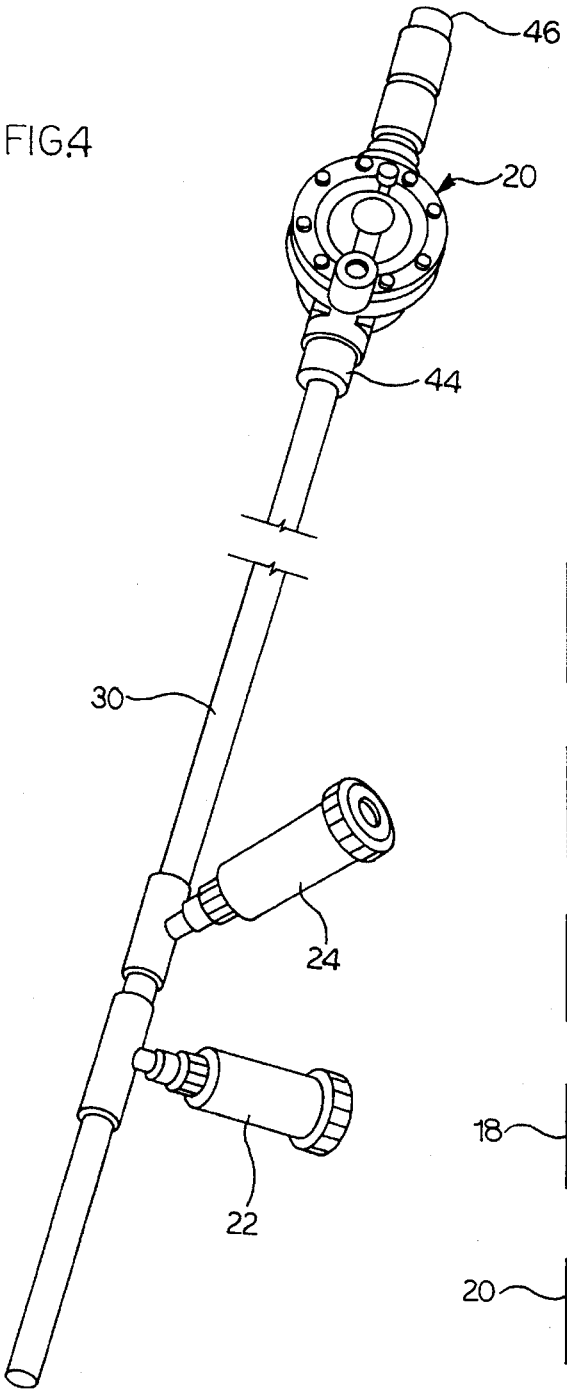
FIG. 4 is a perspective view of the sprinkler nozzles and the in-line valve.

FIG. 2 is a front elevational view of the present invention anti-graffiti apparatus 10. FIG. 3 is a side elevational view of the present invention anti-graffiti apparatus 10. FIG. 4 is a perspective view of the two side-by-side adjacent sprinkler heads 22 and 24, and the in-line valve 20. Referring to FIGS. 2, 3 and 4, the anti-graffiti apparatus 10 comprises a generally elongated triangular shaped protective armor 12, at least one passive infrared sensor 18, at least one in-line valve 20 and at least two side-by-side adjacent sprinkler heads or nozzles 22 and 24.

The triangular shaped protective armor 12 may be made of hard plastic material or fifteen (15) gauge metal material. The protective armor 12 has two inclined panels 14 which are approximately at 45° angles, wherein one of the inclined panels 14 faces the ground and the other inclined panel faces the sky. The protective armor 12 protects the components of the anti-graffiti apparatus 10 The inclined panels 14 of the protective armor 12 are formed in a specific angle of 45° "A" so that the passive infrared sensor 18 installed within the protective armor 12 can be activated above a height of 8 feet 3 inches and below a height of 18 feet. Because of the two inclined panels 14 of the protective armor 12 are formed at 45° "A" angles, the sensor 18 can be set to a maximum height of 18 feet while other prior art sensors can only be set on a 90° angle at a maximum height of 8 feet 3 inches. The protective armor 12 is custom designed to the specification of a particular application. The protective armor 12 may comprise a plurality of sensor apertures 26 (only one is shown in FIGS. 1 and 2) and a plurality of side-by-side sprinkler head apertures 28. The number of apertures 26 and 28 depends on the number of passive infrared sensors 18 and two adjacent side-by-side sprinkler heads 22 and 24 are being utilized.

Each two side-by-side adjacent sprinkler nozzles 22 and 24 are at "D" distance from each other as shown in FIG. 2. By way of example, the distance "D" is approximately 7.5 feet. These sprinkler heads are 180° half heads and have a range of approximately 15 feet in radius. By way of example, the two side-by-side sprinkler nozzles 22 and 24 are model number 560 manufactured by Toro. The two side-by-side adjacent sprinkler heads 22 and 24 are located approximately 2¼ inches apart from each other such that the sprinkler head 22 is approximately parallel to and sprays the building wall 4 and the other sprinkler head 24 is approximately at a 45° angle relative to the sprinkler head 22 and sprays the tagger. The two side-by-side adjacent sprinkler heads 22 and 24 overlap each other for spraying the building wall and the tagger. The pop out sprinkler heads are angled to be moved in accordance to the average graffiti height and the varying height of the device.

The two side-by-side adjacent sprinkler nozzles 22 and 24 are mounted within the protective armor 12 and protrude out from their respective apertures 28 for spraying water against a specific area of the building wall 2. An elongated water supply conduit 30 is mounted within the protective armor 12. The water supply conduit 30 is connected to the two side-by-side adjacent sprinkler heads 22 and 24 for supplying water thereto. By way of example, the water supply conduit 30 is preferably brass material or any other suitable material.

The in-line valve 20 is mounted within the protective armor 12. One end 44 of the in-line valve 20 is connected to the water supply conduit 30 for controlling the water flow to the two side-by-side adjacent sprinkler heads 22 and 24, and the other end 46 is connected to a main water supply line 38 (shown in FIG. 5) for supplying water to the anti-graffiti apparatus 10. By way of example, the in-line valve 20 is model number L6010 (¾") manufactured by the Lawn Genie, Laguna Niguel, Calif.

The passive infrared sensor 18 is mounted within the protective armor 12 and located adjacent to one of the inclined panels 14 which face the ground. Because of the triangular shaped design of the protective armor 12, the 45° angle is an optimal angle for the passive infrared sensor 18. The eye of the passive infrared sensor 18 is aimed directly out from the aperture 26 for allowing the sensor to detect the presence of taggers within the specific area. The passive infrared sensor 18 has a cover range of 50 feet away from the building wall. The cover range of the infrared sensor 18 can be restricted by bars. Each bar closes the aperture of the eye of the passive infrared sensor 18 for shorting the range to approximately 10 feet. The sensor 18 causes activation of the in-line valve 20 which in turn activates the two side-by-side adjacent sprinkler heads 22 and 24, thereby spraying water onto the building wall and the tagger. The sensor 18 is preferably mounted between 12 feet to 14 feet high. The horizontal range of the sensor 18 is approximately 25 feet from either direction such that every 25 feet on the protective armor 12, there is another passive infrared sensor. By way of example, the passive infrared sensor 18 is model number CX-50AM manufactured by the Optex, Inc., Torrance, Calif.

Figure 5:
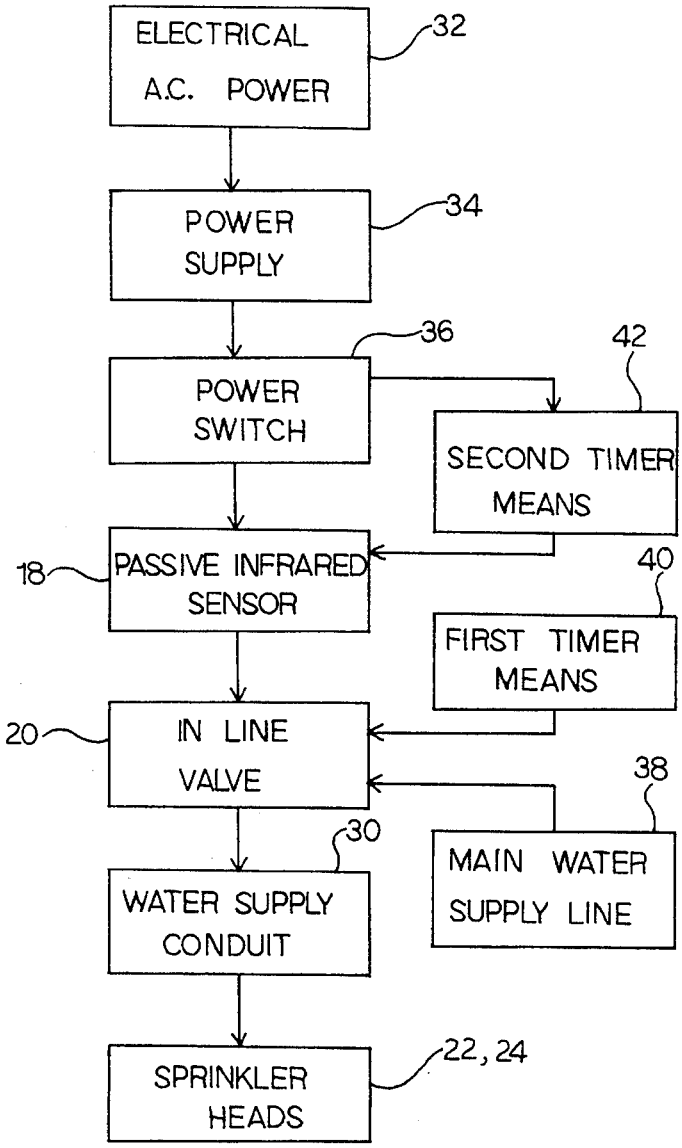
FIG. 5 is a simplified functional block diagram of the present invention anti-graffiti apparatus.

Referring to FIG. 5, there is shown a simplified functional block diagram of the present invention anti-graffiti apparatus. A first timer means 40 is provided with the anti-graffiti apparatus and is electrically connected to the in-line valve 20 for controlling the time limit to deactivate the two side-by-side adjacent sprinkler heads 22 and 24 from spraying water. Normally, the time limit for shutting off the in-line valve 20 is approximately one minute. It is normal that the timer means 40 is capable of being connected to six or more in-line valves. All components (such as the in-line valve, the two side-by-side sprinkler heads, the passive infrared sensor and electrical lines) are contained in the protective armor 12 to prevent vandals from damaging the anti-graffiti apparatus 10. By way of example, the timer means 40 is a full function timer, such as model number 6060 manufactured by the Altronix Corporation, Brooklyn, N.Y.

A 120-volts alternating current supply 32 is connected to a power supply 34 which supplies power to the anti-graffiti apparatus. By way of example, the power supply 34 is a supervised power supply/charger such as model number PM212 manufactured by the Altronix Corporation, Brooklyn, N.Y. A power switch 36 is provided and connected to the power supply 34 for manually activating and deactivating the anti-graffiti apparatus. The switch 36 is conveniently mounted on a wall for a user to activate and deactivate the anti-graffiti apparatus. The power switch 36 can be mounted anywhere that is accessible to a user. The power switch 36 has two positions, an "OFF" position and an "ON" position. When the power switch 36 is switched to the "ON" position, it initializes the anti-graffiti apparatus 10.

It will be appreciated that the power supply 34, the power switch 36, the passive infrared sensor 18, in-line valve 20 and the first timer means 40 are all conventionally wired, and the description thereof will not be described since it will not be too hard for one skilled in the art to electrically wire the anti-graffiti apparatus.

Since most tagging occurs somewhere between 2:00 A.M. and 5:00 A.M. in the morning, a second timer means 42 which is similar to the first timer means 40 may be provided for automatically activating and deactivating the anti-graffiti apparatus so that the passive infrared sensor 18 will only operate in the manner described during these peak tagging times and will be shut off during other times when there is more likely to be pedestrian traffic (and therefore less likely to be taggers) walking adjacent to the building wall.

The operation of the foregoing embodiment now will be described. The motion of the tagger is sensed by the passive infrared sensor 18 which activates the in-line valve which in turn activates the two side-by-side adjacent sprinkler heads 22 and 24 to spray water on the building wall and the tagger, thereby deterring the tagger from performing an unauthorized tagging on private or public property.

It will be appreciated that the model numbers given above are merely one illustrative embodiment and can include many other compatible off-the-shelf components. It is emphasized that while these off-the-shelf components are the preferred model numbers, it is also within the spirit and scope of the present invention substitute compatible off-the-shelf components.

It will be appreciated that the angle and dimensions described above are merely one illustrative embodiment and can include many other comparable sets of angles and dimensions.

Defined in detail, the present invention is an anti-graffiti apparatus in combination with a wall of a building which has a specific area and a main water supply line for deterring a tagger from performing tagging, the apparatus comprising: (a) an elongated protective armor mounted on said building wall and having one panel approximately at a 45° angle facing the ground, the panel having at least three apertures; (b) at least two side-by-side adjacent sprinkler heads mounted within said protective armor and protruding out from a respective two of said at least three apertures of said panel for respectively spraying water against said specific area of said building wall and at the tagger; (c) a water supply conduit mounted within said protective armor and connected to said at least two side-by-side adjacent sprinkler heads for supplying water to said at least two side-by-side adjacent sprinkler heads; (d) at least one in-line valve mounted within said protective armor and having one end connected to said water supply conduit for controlling the water flow to said at least two side-by-side adjacent sprinkler heads and the other end connected to said main water supply line; (e) at least one passive infrared sensor mounted within said protective armor and protruding out from a respective one of said at least three apertures of said panel for detecting the presence of the tagger within said specific area, the at least one passive infrared sensor causing activation of said at least one in-line valve which in turn activates said at least two side-by-side adjacent sprinkler heads, thereby spraying water onto said building wall and the tagger; (f) timer means electrically connected to said in-line valve for controlling the time limit to deactivate said at least two side-by-side adjacent sprinkler heads from spraying water; (g) means for electrically powering said anti-graffiti apparatus; (h) whereby when motion is sensed by said at least one infrared sensor, said at least one infrared sensor activates said in-line valve which in turn activates said at least two side-by-side adjacent sprinkler heads to spray water on said building wall and the tagger, thereby deterring the tagger from performing tagging on said building wall.

Defined broadly, the present invention is an anti-graffiti apparatus in combination with a fixed structure which has a specific area and a main water supply source for deterring a tagger from performing tagging, the apparatus comprising: (a) a protective armor mounted on said fixed structure and having one panel at an angle facing the ground; (b) at least two side-by-side sprinkler heads mounted within said protective armor and protruding out from said panel for respectively spraying water against said specific area of said fixed structure and at the tagger; (c) a water supply conduit mounted within said protective armor and connected to said at least two side-by-side sprinkler heads for supplying water thereto; (d) at least one valve mounted within said protective armor for controlling water flow to said at least two side-by-side sprinkler heads, the at least one valve having one end connected to said water supply conduit and the other end connected to said main water supply source; (e) at least one sensor mounted within said protective armor and sensing motion outside of said panel for detecting the presence of the tagger within a specific area, the at least one sensor causing activation of said at least one valve which in turn activates said at least two side-by-side sprinkler heads, thereby respectively spraying water onto said specific area of said fixed structure and at the tagger; (f) means for electrically powering said anti-graffiti apparatus; (g) whereby when motion is sensed by said at least one sensor, said at least one sensor activates said at least one valve which in turn activates said at least two side-by-side sprinkler heads to respectively spray water on said specific area of said fixed structure and at the tagger, thereby deterring the tagger from performing tagging on said fixed structure.

Defined more broadly, the present invention is an apparatus in combination with a structure for deterring a tagger from performing tagging, the apparatus comprising: (a) a spraying device capable of spraying fluid against said structure and at the tagger; (b) at least one valve for controlling fluid flow to said spraying device; and (c) at least one sensor for detecting the presence of the tagger, the at least one sensor causing activation of said at least one valve which in turn activates said spraying device, thereby spraying fluid onto said structure and at the tagger; (d) whereby when motion is sensed by said at least one sensor, said at least one sensor activates said at least one valve which in turn activates said spraying device to spray fluid on said structure and at the tagger, thereby deterring the tagger from performing tagging on said structure.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. An anti-graffiti apparatus in combination with a wall of a building which has a specific area and a main water supply line for deterring a tagger from performing tagging, the apparatus comprising:

a. an elongated protective armor mounted on said building wall and having one panel approximately at a 45° angle facing the ground, the panel having at least three apertures;

b. at least two side-by-side adjacent sprinkler heads mounted within said protective armor and protruding out from a respective two of said at least three apertures of said panel for respectively spraying water against said specific area of said building wall and at the tagger;

c. a water supply conduit mounted within said protective armor and connected to said at least two side-by-side adjacent sprinkler heads for supplying water to said at least two side-by-side adjacent sprinkler heads;

d. at least one in-line valve mounted within said protective armor and having one end connected to said water supply conduit for controlling the water flow to said at least two side-by-side adjacent sprinkler heads and the other end connected to said main water supply line;

e. at least one passive infrared sensor mounted within said protective armor and protruding out from a respective one of said at least three apertures of said panel for detecting the presence of the tagger within said specific area, the at least one passive infrared sensor causing activation of said at least one in-line valve which in turn activates said at least two side-by-side adjacent sprinkler heads, thereby spraying water onto said building wall and the tagger;

f. timer means electrically connected to said in-line valve for controlling the time limit to deactivate said at least two side-by-side adjacent sprinkler heads from spraying water; and g. means for electrically powering said anti-graffiti apparatus, whereby when motion is sensed by said at least one infrared sensor, said at least one infrared sensor activates said in-line valve which in turn activates said at least two side-by-side adjacent sprinkler heads to spray water on said building wall and the tagger, thereby deterring the tagger from performing tagging on said building wall.

2. The anti-graffiti apparatus in accordance with claim 1 further comprising another timer means for automatically activating and deactivating said anti-graffiti apparatus.

3. The anti-graffiti apparatus in accordance with claim 1 wherein said means for electrically powering said anti-graffiti apparatus is a 120-volts alternating current supply.

4. The anti-graffiti apparatus in accordance with claim 3 wherein said 120-volts alternating current supply is connected to a power supply for supplying power to said at least one in-line valve, said timer means and said at least one passive infrared sensor.

5. An anti-graffiti apparatus in combination with a fixed structure which has a specific area and a main water supply source for deterring a tagger from performing tagging, the apparatus comprising:

a. a protective armor mounted on said fixed structure and having one panel at an angle facing the ground;

b. at least two side-by-side sprinkler heads mounted within said protective armor and protruding out from said panel for respectively spraying water against said specific area of said fixed structure and at the tagger;

c. a water supply conduit mounted within said protective armor and connected to said at least two side-by-side sprinkler heads for supplying water thereto;

d. at least one valve mounted within said protective armor for controlling water flow to said at least two side-by-side sprinkler heads, the at least one valve having one end connected to said water supply conduit and the other end connected to said main water supply source;

e. at least one sensor mounted within said protective armor and sensing motion outside of said panel for detecting the presence of the tagger within a specific area, the at least one sensor causing activation of said at least one valve which in turn activates said at least two side-by-side sprinkler heads, thereby respectively spraying water onto said specific area of said fixed structure and at the tagger; and f. means for electrically powering said anti-graffiti apparatus, whereby when motion is sensed by said at least one sensor, said at least one sensor activates said at least one valve which in turn activates said at least two side-by-side sprinkler heads to respectively spray water on said specific area of said fixed structure and at the tagger, thereby deterring the tagger from performing tagging on said fixed structure.

6. The anti-graffiti apparatus in accordance with claim 5 further comprising timer means electrically connected to said at least one valve for controlling the time limit to deactivate said at least two side-by-side sprinkler heads from spraying water.

7. The anti-graffiti apparatus in accordance with claim 6 further comprising another timer means for automatically activating and deactivating said anti-graffiti apparatus.

8. The anti-graffiti apparatus in accordance with claim 5 wherein said angle of said panel is approximately a 45°.

9. The anti-graffiti apparatus in accordance with claim 5 wherein said at least one valve is an in-line valve.

10. The anti-graffiti apparatus in accordance with claim 5 wherein said at least one sensor is a passive infrared sensor.

11. The anti-graffiti apparatus in accordance with claim 5 wherein said at least one sensor is a motion detector sensor.

12. The anti-graffiti apparatus in accordance with claim 5 wherein said means for electrically powering said anti-graffiti apparatus is a 120-volts alternating current supply.

13. The anti-graffiti apparatus in accordance with claim 12 wherein said 120-volts alternating current supply is connected to a power supply for supplying power to said at least one valve and said at least one sensor.

14. The anti-graffiti apparatus in accordance with claim 5 further comprising switch means for activating and deactivating said anti-graffiti apparatus.

15. An apparatus in combination with a structure for deterring a tagger from performing tagging, the apparatus comprising:

a. a spraying device having at least two side-by-side adjacent sprinkler nozzles and capable of spraying fluid against said structure and at the tagger;

b. at least one valve for controlling fluid flow to said spraying device; and c. at least one sensor for detecting the presence of the tagger, the at least one sensor causing activation of said at least one valve which in turn activates said spraying device, thereby spraying fluid onto said structure and at the tagger; and whereby when motion is sensed by said at least one sensor, said at least one sensor activates said at least one valve which in turn activates said spraying device to spray fluid on said structure and at the tagger, thereby deterring the tagger from performing tagging on said structure.

16. The apparatus in accordance with claim 15 further comprising a protective armor for protecting said apparatus from the tagger.

17. The apparatus in accordance with claim 15 further comprising timer means electrically connected to said at least one valve for controlling the time limit to deactivate said spraying device from spraying fluid on said structure and at the tagger.

18. The apparatus in accordance with claim 17 further comprising another timer means for automatically activating and deactivating said apparatus.

19. The apparatus in accordance with claim 15 further comprising switch means for manually activating and deactivating said apparatus.

20. The apparatus in accordance with claim 15 wherein said at least one valve is an in-line valve.

21. The apparatus in accordance with claim 15 wherein said at least one sensor is a passive infrared sensor.

* * * * *